United States Patent [19]

Martellock

[11] 4,078,948

[45] Mar. 14, 1978

[54] FIXING METHOD

[75] Inventor: Arthur C. Martellock, Pittsford, N.Y.

[73] Assignee: Xerox Corporation, Stamford, Conn.

[21] Appl. No.: 662,657

[22] Filed: Mar. 1, 1976

[51] Int. Cl.[2] ..... G03G 15/20; B05D 5/08

[52] U.S. Cl. ..... 148/6; 427/22; 427/277; 427/278

[58] Field of Search ..... 427/22, 277, 278; 148/6

[56] References Cited

U.S. PATENT DOCUMENTS 3,937,637 2/1976 Moser et al. ..... 427/22 X

*Primary Examiner*—James R. Hoffman

*Attorney, Agent, or Firm*—James J. Ralabate; Ernest F. Chapman

[57] ABSTRACT

Polymer fluids having oxidizable side chains are used on fusing devices in photocopiers to fix particulate thermoplastic toner to a substrate while the toner is in a fused state. Typical polymers are the polysiloxanes having oxidizable alkyl side chains. The polymers can be continuously applied in minimal thicknesses on the fusing device to form a thermally stable, renewable, self-cleaning layer having excellent toner release properties.

12 Claims, 2 Drawing Figures

FIXING METHOD

BACKGROUND OF THE DISCLOSURE

This invention relates generally to xerographic copying methods and apparatus, and more particularly, it relates to the fixing of particulate thermoplastic toner by direct contact with the surface of a fusing member having a novel fluid release surface.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto.

In order to affix or fuse electroscopic toner material onto a support member permanently by heat, it is necessary to elevate the temperature of the toner material to a point at which the constituents of the toner material coalesce and become tacky. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to affect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner at which temperature the toner particles in the image areas of the toner liquify and cause a splitting action in the molten toner resulting in "hot offset". Splitting occurs when the cohesive forces holding the viscous toner mass together are less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surrounding of the reproducing apparatus.

One arrangement for minimizing the foregoing problems, particularly that which is commonly referred to as "offsetting", has been to provide a fuser roll with an outer surface or covering of polytetrafluoroethylene, known by the trade name "Teflon" to which a release agent such as silicone oil is applied, the thickness of the Teflon being on the order of several mils and the thickness of the oil being less than 1 micron. Silicone oil, polydimethylsiloxane, which possesses a relatively low surface energy, has been found to be a material that is suitable for use in the heated fuser roll environment where Telfon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate, such as the solid Teflon outer surface or covering of the aforementioned arrangement. The resulting roll structure is subject to wear and degradation due to continued operation at elevated temperatures and also to damage from accidental gouging by stripper fingers conventionally employed in such systems. The foregoing, in many instances, necessitates replacement of the fuser roll which is quite costly when a large number of machines is involved.

Moreover, the polytetrafluoroethylene along with the coating of silicone oil is of sufficient thickness to constitute a poor thermal conductor, and longer nip dwell and higher fuser roll temperatures are required to deliver the fusing energy required to fix toner. Also, control of the surface temperature of the roll presents a problem due to large temperature variations occurring before and after contacting of the substrate carrying the images.

Silicone elastomers have also been used on the surface of fuser members for fixing thermoplastic toners on receptor surfaces. In U.S. Pat. No. 3,669,707 issued June 13, 1972, silicone elastomers containing fluorinated organic polymer fillers of specified surface energy are used on the surface of fuser members for fixing toner materials. However, the coating is of sufficient thickness to constitute a poor thermal conductor, and longer nip dwell and higher fuser roll temperatures are required as in the case described above. Furthermore, the silicone gum filler is, of necessity, a dual component system to prevent hot offset. This in turn leads to additional preparation and handling problems.

In view of the foregoing it would appear that the high thermal conductivity and wear resistance of bare metals or similar materials would be desirable for utilization in fuser member structures and certain materials have been found which are satisfactory for such application. Commonly used release agents such as pure silicone oils and mineral oils, have been tried in combination with various metals and other high surface energy materials but with relatively little or no success. However, certain materials have been found which are satisfactory for such application. These materials, fusing methods and devices are described in Assignee's co-pending patent application Ser. No. 383,231 filed July 27, 1973, now U.S. Pat. No. 3,937,637, which includes providing a coating of a polymer release material of the type which oxidizes and thereafter is capable of reacting with the fuser surface material to form a first barrier coating portion upon the fuser member and a second replenishing release portion thereon. In Assignee's copending application Ser. No. 491,415 filed July 24, 1974, a coating of polymeric fluid containing built-in functional groups which interact with the fuser member surface to provide an interfacial barrier layer and a low surface energy film of the fluid, is provided upon a fuser member. Exemplary of the build-in functional groups in the foregoing reference are carboxy, hydroxy, epoxy, amino, isocyanate, thioether and mercapto.

OBJECTS OF THE INVENTION

It is the principal object of this invention to provide a new and improved fusing process and device for use in fixing toner images.

Another object of this invention is to provide, for use in a photocopying apparatus and process, a fusing process, device and release agent wherein the fuser member has a continuously renewable surface.

Another object of this invention is to provide a fusing process and device wherein toner is displaced from the exposed surface of the fuser member by the action of a release agent on the surface of the fuser member, the release agent having a polymeric backbone with oxidizable side chains thereon.

Another object of this invention is to provide, in an electrophotographic apparatus, a method for control of the release properties of the fuser surface.

Still another object of this invention is to provide a fusing process, device and release agent having controllably oxidizable characteristics, wherein an interfacial barrier is formed intermediate the fuser member surface and the release layer applied thereto.

Another object of this invention is to provide a fusing device and process for toner images wherein a barrier is formed during operation of the fuser at the interface of the fuser roll surface and a controllably oxidizable release agent through interaction between the release agent and the fuser roll material.

Still another object of this invention is to provide a new and improved tailor-made oxidizable release agent, device and method for fusing toner images to a substrate wherein toner barrier and toner release coatings are formed on a thermally conductive core and wherein the combined thickness of the coatings is insufficient to establish an appreciable thermal barrier to the energy being conducted through the core, thereby lowering the power requirements for maintaining a heated core and for the overall fusing operation.

Other objects and advantages of the present invention will become apparent when read in conjunction with the accompanying drawings and specification.

SUMMARY OF THE INVENTION

The above-cited objects of the present invention are accomplished by applying a special class of polymers to a heated fuser member in an electrostatic reproducing apparatus. The polymers of the present invention must contain a backbone having at least one oxidizable group per molecule, that is, one capable of undergoing thermal oxidation so that the thermal oxidative product thereof is capable of interaction with the fuser member surface and thereby provides a thermally stable interfacial barrier to the toner. A preferred polymer of the foregoing class is a polysiloxane having at least one oxidizable alkyl group per molecule, hereinafter referred to as a polyalkylsiloxane. The polymer is applied in an amount sufficient to cover the surface of the fuser member with at least a continuous, low surface energy film of fluid to provide the fuser member with a surface which releases thermoplastic resin toner heated by the fuser member and prevents said thermoplastic resin toner from contacting the surface of the fuser member. At least one of the oxidizable groups per molecule of the polymer must be capable of thermal oxidation in the presence of air or oxygen to form an oxidation product which interacts with the fuser member surface to form a thermally stable barrier to toner, said barrier designated herein as an interfacial layer, which strongly adheres to the metal, glass or other substrate of the fuser member surface and provides a thin coating which has excellent release properties for the toners used in electrostatic printing. The polyalkylsiloxanes containing substituent long-chain hydrocarbon alkyl groups are preferred for the method and device of the present invention.

The present invention includes a method of providing release agents for coating fuser members from otherwise thermally stable, non-oxidizable polymers such as polysiloxanes. The thermally stable, non-oxidizable polymers such as polysiloxanes, e.g., polydimethylsiloxane, which are ineffective as release agents on bare metal or glass fuser members, become effective release agents when thermally oxidizable alkyl or other oxidizable side chains are built into the polysiloxane backbone. In fact, when the polysiloxane contains as little as one alkyl group per molecule, the alkyl group comprising at least two carbon atoms, and the alkyl group is thermally oxidizable, that is, capable of oxidizing in the presence of air or oxygen at elevated temperatures, the unique release characteristics as well as the formation of the thermally stable interfacial barrier, is present. Furthermore, by varying either the number of oxidizable groups per molecule, by varying the chain length of one or more of the oxidizable groups, or by a combination of the foregoing, tailor-made and/or optimum release conditions can be provided for various types of thermoplastic resin toners, various fuser member surfaces and/or various operating temperatures.

The polymers of this invention may be applied to the surface of the fuser member in thicknesses ranging from submicron to several microns to constitute a minimal barrier to heat transfer. By employing the polymeric release agents and process of this invention, there is provided a fuser member having in essence, a bare surface surrounded only by a minute layer of material which prevents toner from contacting the surface.

While the mechanism is not completely understood, it has been observed that when this type of polymer fluid having at least one oxidizable group per molecule, is applied to the surface of a fuser device, there is an interaction (a chemical reaction or a thermal oxidative decomposition) between the metal or glass surface of the fuser and the polymer, so that an interfacial barrier layer comprising the reaction product between the metal, glass or other material of the fuser member and the oxidizable groups is formed intermediate the metal or glass or other substrate of the fuser member and the outer layer of polymer fluid coating the fuser member. This outer layer may be referred to as the non-reacted release layer, or generally, the release layer. The coating, however formed, has been observed to have a greater affinity for the fuser substrate material than the toner and thereby prevents electroscopic thermoplastic resin toners from contacting the core, while the release coating provides a material the cohesive force of which is less than the adhesive forces between the heated toner and the substrate to which it is applied, and the cohesive forces of the toner. Not only do these coatings have excellent release properties, but it has also been observed that the thermally-stable layer is continuously renewable and self-repairing. This is to say, if this coating is damaged, for example, by uneven pressures exerted by the blade utilized for metering the release material to the core, or by undue forces exerted by the finger employed for stripping the substrate from the fuser roll structure, the thermally-stable coating will repair itself.

Studies of the thermal oxidative decomposition of a thin film of a polymethylalkylsiloxane fluid containing substituent long-chain hydrocarbon groups have been conducted by Willis and Shaw, and are reported in *Journal of Colloid and Interface Science,* Vol. 31, No. 3, November 1969, pp. 397–408. Therein is described the formation of polysiloxane films on metal surfaces and proposed mechanism therfor, and this reference is incorporated herein by reference especially insofar as defining the preferred polysiloxane having alkyl groups which oxidize at elevated temperatures.

It was also observed unexpectedly that toner of the type commonly used in electrostatic printing is displaced from damaged or worn areas which interrupt the coatings on the heated fuser member when polymer fluids having oxidizable groups as above described, are used in accordance with the present invention. The softened or tacky toner is substantially removed by the polymer fluid, and the fluid repairs the interrupted, damaged or worn area. This mechanism has substantially reduced offset problems common to the devices and processes of the prior art.

By using the term "fluid" in describing the coating materials or release fluids of this invention is meant the state which the polymer material assumes at operating temperatures. Thus, for example, the polyalkylsiloxane material may be a solid or a liquid at ambient temperature and a fluid at operating temperatures.

By use of the phrase "capable of displacing electroscopic thermoplastic resin toner" as used herein, is meant that the polymer fluid having oxidizable groups is operable in preventing the toner from contacting the surface of the fuser member and is more reactive than the toner with the material of the fuser member surface to the extent that it repels or displaces the toner from the surface of the fuser member even when the surface thereof is exposed to or contacts the toner.

DESCRIPTION OF THE PREFERRED EMBODIMENTS

Figure 1:
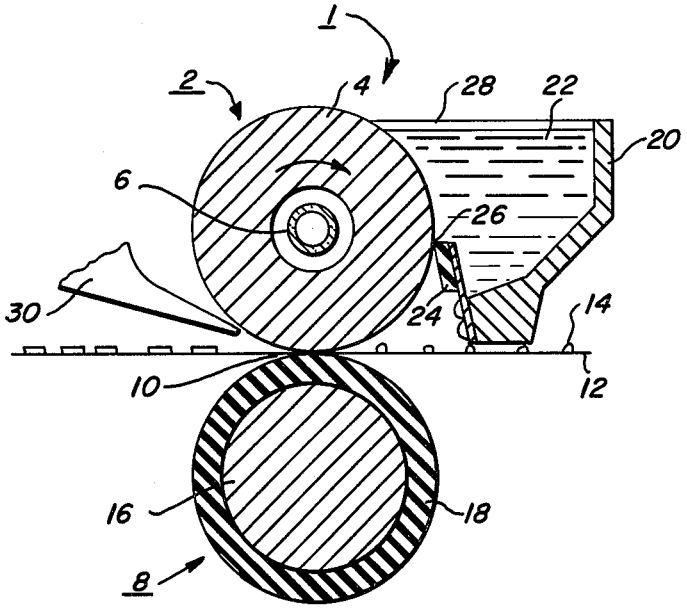
FIG. 1 is a side elevational view of a typical fuser system for a xerographic reproducing apparatus.

The polymer fluids capable of releasing electroscopic thermoplastic resin toners are operable in accordance with the present invention only when the appropriate thermally oxidizable groups are present on the backbone of the polymer. The polymer fluid preferably forms an interfacial barrier between the metal, glass or other material of the fuser member and the outer layer of the same fluid release material. In accordance with the present invention, this characteristic is typically found in polyalkylsiloxane fluids which comprise, for example, such alkyl groups as decyl, octadecyl, and other alkyl groups having two or more carbon atoms and preferably having from about 3 to about 22 carbon atoms, and which oxidize in the presence of air or oxygen at elevated temperatures when they are attached to the polysiloxane polymer chain.

Specific typical polyalkylsiloxane fluids of the present invention have a polymeric backbone of the general formula:

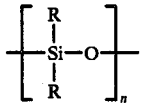

where $n$ is an appropriate number such that the polymeric material assumes a fluid state (liquid) at operating temperatures which are generally from about 200° F (93° C) to about 450° F (232° C); where at least one R in the molecule is an alkyl group having two or more carbon atoms and the remaining R substituents are alkyl having one or more carbon atoms and mixtures thereof. For example, one R in the molecule may be an octadecyl group and the remaining R groups may be methyl groups, or for example, in another embodiment R may be a mixture of decyl, methyl, butyl and ethyl groups. Thus, all R's in the molecule may be the same if they are alkyl groups having two or more carbon atoms, however, the R's may be mixtures of alkyl groups including methyl groups as long as there is the critical limitation of at least one alkyl group per molecule and the alkyl group has two or more carbon atoms. Furthermore, the R's may also comprise other essentially non-reactive substituents, for example, aryl groups, halogenated alkyls and aryls which have essentially non-reactive halogens, and the like, and even substituted non-reactive inorganic substituents substituted on the silicon atom as long as there is at least one alkyl group having two or more carbon atoms per polysiloxane molecule, said alkyl group being capable of oxidizing at elevated temperatures and thereafter interacting with the material of the fuser member surface to provide a thermally stable interfacial barrier layer to thermoplastic resin toner and an outer release layer.

A preferred class of polyalkylsiloxanes useful as release agents in accordance with the present invention are the polymethylalkylsiloxanes, the molecular structure of which may be designated as:

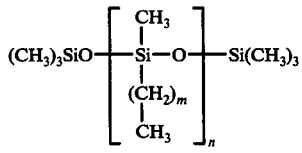

where $m$ is one or greater than one and $n$ is two or more. A particularly useful polyalkylsiloxane fluid is polymethyldecylsiloxane where $m=9$ and $n=6$–8, the low molecular weight fluid containing approximately $n=6$ (18 percent), $n=7$ (65 percent) and $n=8$ (17 percent) alkyl substituents. Generally, those polyalkylsiloxanes with an alkyl chain length of less than 16 carbon atoms are liquid at room temperature, and are useful in accordance with the present invention, however, as explained supra, as long as the polyalkylsiloxane is fluid or liquid at operating temperatures, it is useful herein. Thus, alkyl chain lengths of 16 carbon atoms or more are useful as long as the polyalkylsiloxane is fluid or liquid at operating temperatures. Another preferred class of polyalkylsiloxanes have the formula:

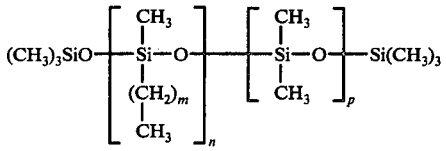

where $m$ is one or greater than one; $n$ is one or greater than one and $p$ is one or greater than one. Specifically exemplary examples include those polyalkylsiloxanes where $m = 1$–$16$, $n + p = 6$–$8$ and $n$ is at least one.

Other polymer fluids, i.e., fluids at operating temperatures, capable of releasing toner images and having thermally oxidizable groups present on a thermally stable polymer backbone include block copolymers having a thermally stable backbone and at least one oxidizable alkyl side chain, thermally stable homopolymer backbones having at least one oxidizable alkyl side chain and normally thermally stable copolymers having at least one oxidizable alkyl side chain. These oxidizable alkyl side chains may also comprise other reactive or non-reactive groups as long as the reactive or non-reactive groups do not interfere with the interaction between the polymer fluid and the fuser member surface, with the ability of the polymer fluid to release the heated toner images, or with any of the other process and apparatus parameters of electrostatographic reproduction.

Representative examples of alkyl groups at least one of which may be present per molecule in the polyalkylsiloxanes of the present invention, and which are capable of oxidizing at elevated temperatures when present as an substituent on the polysiloxane, are ethyl, propyl, isopropyl, butyl, isobutyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl and the like. Furthermore, the alkyl groups may be straight chain or branched, the only limitation being that the polyalkylsiloxane be fluid at operating temperatures and capable of oxidizing at elevated temperatures and interacting with the fuser member surface at least at the operating temperatures.

In order to control the thermal oxidation of the polymers having oxidizable groups, as exemplified by the polyalkylsiloxanes, in air or oxygen at operating temperatures and thereby control the interaction between the polyalkylsiloxane and the material of the fuser member surface, the number and size of the alkyl groups on the siloxane molecule backbone can be varied. For example, if the number of the alkyl groups or the size of the alkyl groups or both are increased, there is a greater amount of thermal oxidation of the polyalkylsiloxane resulting in an increased amount of interaction between the polyalkylsiloxane and the material of the fuser member surface. If the number of alkyl groups or the size of the alkyl groups or both are descreased, there is a lesser amount of thermal oxidation of the polyalkylsiloxane resulting in a decreased amount of interaction between the polyalkylsiloxane and the material of the fuser member surface. Accordingly, by varying the number of alkyl groups or by varying the size of the alkyl groups, or both, there is provided a method of controlling the release characteristics of polyalkylsiloxane release agents for coating fuser members. Thus, polyalkylsiloxane release agents can be tailor-made to provide optimum release characteristics for various fuser member substrates, thermoplastic resin toners, operating temperatures and the like. By varying the number of alkyl groups or by varying the size of the alkyl groups or both, the viscosity of the polyalkylsiloxane also changes, and accordingly, this parameter may also be taken into consideration when a particular polyalkylsiloxane or mixture of polyalkylsiloxanes is considered as a release agent for thermoplastic resin toner undergoing fixing in an electrostatic reproducing apparatus.

Exemplary of the foregoing method of controlling the release characteristics of the polyalkylsiloxanes and of controlling the thermally stable barrier which is the product resulting from the interaction of the fuser member surface and the oxidation product of the polyalkylsiloxane, is the use of an additional number of alkyl groups or larger alkyl groups or both on the siloxane molecule backbone to increase the amount of interaction between the oxidation product of the polyalkylsiloxane and the fuser member surface material or to increase the cohesive force of the release agent layer or coating or both. Thus, by providing three decyl groups per molecule instead of one decyl group per molecule or by providing pentadecyl alkyl groups on the molecule instead of decyl groups on the molecule or by providing pentadecyl groups on the siloxane backbone chain in addition to the existing decyl groups thereon, or any similar combination where there is an increase in the chain length of the alkyl group or an increase in the number of alkyl groups, there is provided a method of controlling the thermal oxidative properties of the polyalkylsiloxane, and more specifically, a method of increasing the cohesion within the release agent fluid itself and increasing the interaction between the oxidation product of the polyalkylsiloxane and the material of the fuser member surface thereby increasing the stability of the thermally stable barrier layer formed on the fuser member surface. Correspondingly, a method of controlling the release characteristics of the polyalkylsiloxanes and of controlling the thermally stable barrier which is the product resulting from the interaction of the fuser member surface and the oxidation product of the polyalkylsiloxanes, is the use of fewer alkyl groups or smaller (fewer carbon atoms) alkyl groups or both on the siloxane molecule backbone to decrease the amount of interaction between the oxidation product of the polyalkylsiloxane and the fuser member surface material or to decrease the cohesive force of the release agent layer (coating) or both. Thus, by providing one hexyl group per molecule instead of three hexyl groups per molecule or by providing hexyl groups on the molecule instead of decyl groups on the molecule or by providing two hexyl groups and one decyl group on the siloxane backbone chain instead of three dodecyl groups thereon, or any similar combination where there is a decrease in the chain length of the alkyl group or a decrease in the number of alkyl chains, there is provided a method of controlling the thermal oxidation properties of the polyalkylsiloxane and more specifically, a method of decreasing the cohesion within the release agent fluid itself and decreasing the interaction between the oxidation product of the polyalkylsiloxane and the material of the fuser member surface thereby decreasing the stability of the thermally stable barrier layer formed on the fuser member surface.

It is to be considered within the purview of one skilled in the art of manufacturing polyalkylsiloxanes to provide the polyalkylsiloxanes having the desired number of alkyl groups, the desired size of the alkyl groups or both. For example, methods of making such fluids are described by Kirk-Othmer "Encyclopedia of Chemical Technology", Interscience Publishers, volume 18, p.p.237–241 (1969) where it is suggested that methyl alkyl silicone fluids may be prepared by the addition of olefins to methyl hydrogen (MeHSiO) fluids or by the condensation of methylalkylsilanols or by rearrangements of siloxanes.

In order to provide suitable release of thermoplastic toner when bare fuser rolls are used in the process and device of the present invention, the polymeric release agents having oxidizable side chains, preferably have the following properties either before, during or after application to the fuser member surface. The polymer release agents are preferably non-volatile, that is, they do not produce excessive levels of volatile fumes and vapors which penetrate the surrounding atmosphere and thereby cause deposits upon surrounding parts in the copying apparatus or fumes which are toxic, in the environment. The release material upon the fuser member should be thermally stable, that is the fluid must not form a gel or decompose at operating temperatures over reasonable periods of time, for example, at least about 200 hours at operating temperature. This is dependent upon the particular machine and machine use. The fluid is preferably non-corrosive to the machine parts and to the paper, and non-reactive, that is, inert, to the toner used in the development of the electrostatic latent image. During operation the polymer fluid must present a low energy surface to the toner which is undergoing fusing by heat, that is, it must be abhesive, and the surface energy must be less than the surface energy of the molten or heated toner. This is controlled by the cohesive force of the polymer, e.g., polyalkylsiloxane and can be controlled as discussed supra. For example, a conventional toner has a room temperature surface energy of about 28–36 dynes/cm, and the fluid must have a surface energy less than that of the toner. The interfacial layer is preferably impenetrable to the toner, that is, the electroscopic thermoplastic resin toner applied to the fuser member and softened should not be able to penetrate the intact interfacial barrier layer so that the fuser member surface will be exposed to toner particles which may become entrapped within the layers upon the member. The fluids must be capable of application to the fuser member in minute thicknesses preferably of the order of magnitude of 10 microns or less so that only a minimum thermal barrier will be coated upon the bare fuser member, and this property can be controlled by varying the number or size or both of the oxidizable groups on the polymer backbone. It is also preferred that any interfacial layer which forms a barrier between the fuser member surface and the outer release layer remain insoluble in the non-volatile fluid release layer even at the operating temperatures of the device.

Generally, the modes in which the release agents of the present invention are utilized are those wherein the coating can be continuously applied to the surface of the fuser member, and accordingly, the coating is deemed self-renewing in these cases. The polymer, e.g., polyalkylsiloxane, may be applied to the fuser member by any of the standard or conventional methods or devices known to those skilled in the art, and includes application by brushes, by spraying, by metering from a sump, by application from a wiper blade or wiper comprising the polyalkylsiloxane, by applying from a suitable sump, by applying from a wick, by padding, and the like. In general, one skilled in the art will be able to use this invention in the fuser assembly of a copying device wherein thermoplastic resin toner applied to a substrate in image configuration must be heated or fused in order to fix permanently the colored substance in image configuration upon the substrate. The polyalkylsiloxane release material may also be applied in the form of a solid which becomes fluid at operating temperatures, for example, a block of the polymer or elastomer may rub against the heated fuser member to apply a fluid film on the fuser member. The release agent may also be applied in conjunction with a cutting or dilution agent with which it is miscible, that is, as two or more miscible components as described in a copending patent application U.S. Ser. No. 662,656, filed Mar. 1, 1976 assigned to the same assignee as the instant patent application and filed herewith. The release agents of the present invention may also be applied as a single component to provide both the interfacial barrier and the release surface.

In applying the polymer fluid having oxidizable side chains to the surface of the fuser member, the fluid which, upon thermal oxidation, is capable of interacting with the fuser member surface to form a thermally stable interfacial barrier to the toner, must be applied in an amount sufficient to cover the surface with at least a continuous low surface energy film in order to provide the fuser member with a surface which not only releases thermoplastic resin toner heated by the fuser member but also with an amount which will prevent the thermoplastic resin toner from contacting the surface of the fuser member. Generally, in accordance with the objects of the present invention, the amount sufficient to cover the surface must be that amount which will maintain a thickness of the fluid in a range of submicron to microns and is preferably from about 0.5 micron to about 10 microns in thickness. Thus, in essence, the layer of the polymeric fluid on the surface of the fuser member is so slight that there is essentially a bare fuser member. Although this layer or coating of the polyalkylsiloxane fluid may be applied to the fuser member surface intermittently, it is generally preferred to apply the fluid continuously on the heated fuser member to maintain thereon a coating of the fluid and the interaction product or products formed by interaction of the thermal oxidation product of the polymer having oxidizable side chains with the material of the fuser member. During operation of any automatic electrostatic reproducing apparatus, it is generally preferred to continuously apply the fluid on the heated fuser member in order to replace that fluid which is retained by the substrate when the substrate is the type which absorbs the fluid or to which the fluid may adhere, generally in an amount which is measured in fractions of a microliter for each copy. However, in embodiments where there is little or no loss of the fluid from the surface of the fuser member, continuous application of the fluid may not be necessary, and it may be preferred to utilize application techniques which only apply fluid intermittently to the surface.

In general, the method of the present invention applies to fusing electroscopic thermoplastic resin toner images to a substrate and includes the steps of forming a coating or layer on a heated fuser member of an electrostatic reproducing apparatus, said coating being a barrier to electro scopic thermoplastic resin toner and comprising the product resulting from the interaction of the fuser member and the thermal oxidation product of at least one polymer having an oxidizable side chain, e.g., polyalkylsiloxane fluid, said polyalkylsiloxane being fluid at the temperatures of the fuser member and acting as a release coating for the electroscopic thermoplastic resin toner. The toner image on the substrate is contacted with the heated fuser member for a period of time sufficient to soften the electroscopic thermoplastic resin toner, and then the softened toner is allowed to cool. The toner barrier coating and the fluid toner release coating are preferably on the order of about 0.5 micron in thickness. The thickness of the barrier coating and release layer is limited only to the extent that such barrier coating and release layer do not substantially prevent heat transfer from the inner core of the fuser member to the thermoplastic resin toner undergoing fusing upon a substrate, and to the extent that there is a sufficient film of the release material on the surface of the fuser member to prevent hot offsetting on the heated fuser member, that is, to prevent the retention of the tackified or molten thermoplastic resin toner by the surface of the heated fuser member so that the retained toner will not transfer to the next substrate containing the heated fuser member.

The electroscopic thermoplastic resin toner that forms the toner images, for example, numeral 14 in FIG. 1, is comprised of a thermoplastic resin in addition to colorant such as dyes and/or pigments. Examples of conventional pigments are carbon black and furnace black. The developer material may also contain cleaning materials and plasticizers in accordance with the desired formulation. Typical toners may be chosen by one skilled in the art. For example, a copolymerized mixture of styrene of a blend of styrene analogs with 10–40 percent (by weight) of one or more methacrylate esters selected from the group consisting of ethyl, propyl and butyl methacrylates as described in U.S. Pat. No. 3,709,342 may be used, said reference being incorporated herein by reference. Typical toner materials include gum copal, gum sandarac, rosin, asphaltum, pilsonite, phenol formaldehye resin,s rosin-modified phenol formaldehyde resins, methacrylic resins, polystyrene resins, polypropylene resins, epoxy resins, polyethylene resins and mixtures thereof. Among other patents describing the electroscopic toner compositions are U.S. Pat. No. 2,659,670 to Copley; U.S. Pat. No. 2,754,408 to Landrigan; U.S. Pat. No. 3,079,342 to Insalaco; U.S. Pat. No. Re. 25,136 to Carlson and U.S. Pat. No. 2,788,288 to Rheinfrank et al.

The surface to which the tailor-made polymer having oxidizable side chains, e.g., polyalkylsiloxane, is applied, may be heated to insure proper formation of the interfacial layer which is the result of interaction between the thermal oxidation product of the tailor-made fluid and the surface of the fuser member. Thus, the interfacial layer becomes heated and remains as a barrier layer upon the surface of the fuser member. Generally, the unreacted or virgin release fluid as it is applied to the fuser member, is heated to the temperature of the fuser roll, however, the release fluid may be somewhat cooler than the roll during operation of the device when heat transfer takes place, that is, when heat is transferred from the fuser member to the substrate containing thermoplastic resin toner undergoing the fusing process. The temperature may be adjusted by one skilled in the art in accordance with the particular type of thermoplastic resin toner, in accordance with the speed of the apparatus, and in accordance with any other parameters which are known to one skilled in the art.

The release properties of the polymers containing oxidizable side chains, e.g., polyalkylsiloxane fluid, are related to the splitting of the image when the toner is softened and becomes sufficiently sticky to adhere to the surface of the fuser roll which results in a partial or ghost image on the next sheet, producing what is referred to as an offset image. Therefore, the release property of the particular polymer fluid is a function of the offset image, and the higher the temperature off the fuser member before hot offsetting occurs, the better the release properties of the particular fluid. Furthermore, the fusing latitude, that is, the temperature at which the thermoplastic resin toner begins to fuse up to the temperature at which hot offset occurs, is also a function of the release properties of the particular polymer fluid. This fusing latitude, that is, the temperature range at which the fusing member can operate and including the temperature from which the thermoplastic resin toner begins to fuse up to the temperature where hot offset begins to occur, is also known as the fusing window of the fuser member. The fusing latitude is substantially improved over prior art agents when the polysiloxane fluids having tailor-made alkyl groups on the siloxane backbone are applied to the fuser member.

Exemplary of fusing the toner material to the substrate is a fuser assembly which comprises a heated roll structure including a hollow cylinder or core having a suitable heating element disposed in the hollow portion thereof which is coextensive with the cylinder. The heating element may comprise any suitable type of heater for elevating the surface temperature of the cylinder to operational temperatures which are generally from 250°–400° F, and for example, may be a quartz lamp. The cylinder must be fabricated from any suitable material capable of accomplishing the objects of the invention, that is, a material which not only will transfer heat to the surface to provide the temperature required for fusing the toner particles, but also a material having a surface which is capable of interacting with the thermal oxidation product of the polymer release agent to form a product which becomes an interfacial layer or barrier layer to toner intermediate the release layer and the surface of the bare fuser member to prevent toner particles from contacting the fuser surface.

Typical fuser member materials are anodized aluminum and alloys thereof, steel, stainless steel, nickel, and alloys thereof, nickel plated copper, copper, glass, zinc, cadmium, and the like and various combinations of the above. The cylinder may be fabricated from any suitable material which is capable of interacting with the thermal oxidation products of the preferred polysiloxane release fluid having oxidizable alkyl side chains with at least two carbon atoms built into the polysiloxane backbone. Surface temperature of the fuser member may be controlled by means known to those skilled in the art, for example, by means described in U.S. Pat. No. 3,327,096.

In general, the fuser assembly further comprises a backup member, such as a roll or belt structure which cooperates with the fuser roll structure to form a nip through which a copy paper or substrate passes such that toner images thereon contact the fuser roll structure. The backup member may comprise any suitable construction, for example, a steel cylinder on a rigid steel core having an elastomeric layer thereon, or it may be a suitable belt material which provides the necessary contact between the fuser member and the substrate carrying the developed latent image. The dimensions of the fuser member and backup member may be determined by one skilled in the art and generally are dictated by the requirements of the particular copying apparatus wherein the fuser assembly is employed, the dimension being dependent upon the process speed and other parameters of the machines. Means may also be provided for applying a loading force in a conventional manner to the fuser assembly to create nip pressures on the order of about 15 to 150 psi average.

The fuser member treated by the method of the present invention wherein at least one of the designated polyalkysiloxane fluids is applied to a fuser member surface, the thermal oxidation product of said fluid being capable of interacting with the fuser member surface to form a thermally stable interfacial layer and being applied in an amount sufficient to cover the surface with at least a continuous, low surface energy film of the fluid to prevent the toner from contacting the surface of the fuser member and to provide a surface which releases the toner heated by the fuser member, is illustrated in the fuser assembly shown in FIG. 1. In FIG. 1, the numeral 1 designates a fuser assembly comprising heated roll structure 2, backup roll 8 and sump 20. Heated roll 2 includes a hollow cylinder 4 having a suitable heating element 6 disposed in a portion thereon which is coextensive with the cylinder.

Backup roll 8 cooperates with roll structure or solid substrate 2 to form a nip 10 through which a copy paper or substrate 12 passes such that toner images 14 thereon contact heated roll 2. As shown in FIG. 1, the backup roll 8 has a rigid steel core 16 with an elastomer surface or layer 18 thereon.

Cylinder 4 being fabricated of metal such as anodized aluminum, auminum and alloys thereon, steel, nickel and alloys thereof, copper, and the like as described above or glass, has a surface made of relatively high surface energy materials, and consequently toner material 14 contacting such surfaces when they are heated, would readily wet the surface. Accordingly, there is provided in accordance with the embodiment of FIG. 1, sump 20 for containing at least one of the designated polyalkylsiloxane release agents 22 capable of displacing electroscopic thermoplastic resin toner when the agent is in a fluid state, the thermal oxidation product of said release agent being capable of interacting with the fuser member surface to form a thermally stable interfacial layer thereon when in the fluid state. The release material 22 may be a solid or liquid at room temperature, but it must be a fluid at operating temperatures preferably having a relatively low viscosity at the operating temperatures of heated roll 2.

In the embodiment shown in FIG. 1 for applying release material 22 to the surface of heated roll 2, a metering blade 24 preferably of conventional non-swelling rubber is mounted to sump 20 by conventional means such that an edge 26 thereof contacts the solid substrate 2 of the fuser roll structure to serve as a metering means for applying release material 22 to the fuser roll in its liquid or fluid state. By using such a metering blade, a layer of release fluid 22 can be applied to the surface of heated roll 2 in controlled thicknesses ranging from submicron thicknesses to thicknesses of several microns of the release fluid. Thus, by metering device 24, about 0.1 to 0.5 micron or greater thicknesses of release fluid can be applied to substrate 2. In one embodiment shown, a pair of end seals 28, for example, of sponge rubber, are provided to contain the release material 22 in sump 20. One or more stripper fingers 30 may be provided for insuring removal of the substrate 12 from substrate 2. In one of the preferred embodiments, the thermoplastic resin toner is fused to paper, however, thermoplastic resin toner may be fused to other substrates such as polymeric films by the fuser members and process of the present invention, the only limitation being that the polyalkylsiloxane fluids must not adversely react with the substrate upon which the toner is used and must not destroy or alter the coloring properties of the thermoplastic resin toner.

The embodiment described above in FIG. 1 is merely one of the preferred means for applying a layer of the described polymer release materials having oxidizable side chains capable of interacting with the fuser member surface to form a thermally stable interfacial barrier layer in an amount sufficient to cover the surface with at least a continuous, low surface energy film of the fluid to provide the fuser member with a surface which releases thermoplastic resin toner heated by the fuser member. Other means for applying the release fluid which is abhesive to electroscopic thermoplastic resin toner comprise means which spray a layer of the release fluid upon the fuser surface, a pad or sponge-like material which pads a coating of the release fluid on the surface of the fuser member, a wick which contacts the surface of the fuser member to provide a film or layer of the release material, extruding means which extrude a minute film of the release material on the fuser member, a brush having fibers or bristles comprised of the release material or a brush or bristle having the release fluid on the surfaces of the bristles or brush materials, fluid soaked rolls, sponges or wicks and the like.

Figure 2:
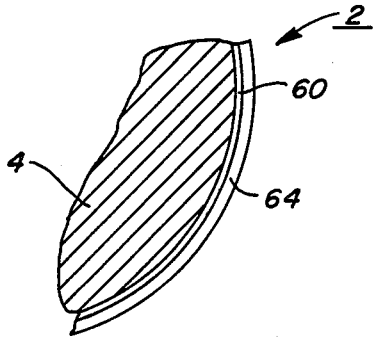
FIG. 2 is a fragmentary view of a typical fuser member of the present invention.

The fuser member for an electrostatic reproducing apparatus resulting from the method of treating the surface of a heated fuser member with at least one polymer fluid having oxidizable side chains, for example, polyalkylsiloxane fluid, capable of displacing electroscopic thermoplastic resin toner, is shown in FIG. 2. The fuser member shown in FIG. 2 is magnified many times over the member shown in FIG. 1 in order to show the thin layers on the fuser member surface. In FIG. 2, the solid portion of the heated roll is designated by numeral 4. A release layer of fluid is designated by numeral 64 and an interfacial layer is designated by numeral 60. Thus, there is described a fuser member having a solid substrate 4, a release layer of polymer fluid having oxidizable side chains for example, polyalkylsiloxane fluid 64, which is abhesive to electroscopic toner and the thermal reaction product of which interacts with the solid substrate 4, and interfacial layer 60 which prevents the electroscopic thermoplastic resin toner (not shown) from contacting solid substrate 4, said interfacial layer 60 being formed by the interaction of solid substrate 4 and the thermal reaction product of the polymeric fluid release layer 64.

In one of the preferred embodiments, solid substrate 4 of FIG. 2 comprises a metal capable of forming oxides, and in more preferred embodiments, the solid substrate 4 may be selected from the group consisting of iron, copper, aluminum, titanium, zinc, silver, nickel and cadmium and oxide-forming alloys thereof. Solid substrate 4 may also be comprised of glass and other oxide-forming media.

In accordance with the present invention, it has been unexpectedly observed that when solid substrate 4 in FIG. 2 is an oxide-containing or -forming material and the release agent 64 is the designating polyalkylsiloxane fluid, and electroscopic toner is applied thereto and softened, the electroscopic toner is displaced from solid substrate 4 by the action of fluid 64 applied thereto when release layer 64 and interfacial layer 60 are interrupted, and the surface of the substrate 4 is exposed to the toner. Interruptions in the release layer 64 and interfacial layer 60 may occur, for example, by scraping the surface by the stripper finger, by a thermistor device to control the temperature at the surface, by other abrasive forces which scratch or deface the layers coated on solid substrate 4, and the like. Thus, when the electroscopic toner is applied to the surface which has been interrupted by such forces, it was unexpectedly found that the electroscopic toner is displaced from the solid substrate 4 by the action of the release layer material as it is applied to the fuser member. Although the details of this mechanism are not completely understood, it is believed that the polyalkylsiloxane release fluids actually compete with the electroscopic toner for the surface of substrate 4, and because the release material is more reactive toward the solid substrate surface 4 than is the electroscopic toner, the release material actually displaces the electroscopic toner from substrate 4 as it reforms interfacial layer 60 in the interrupted zone or portion of the surface by the interaction of the release material 64 and the surface 4. Thus, by using conventional electroscopic thermoplastic resin toners, the release layer fluids are actually found to displace the electroscopic toner applied to and softened upon the surface of the fuser roll from any interruptions occurring therein, thereby preventing offsetting of the material and ghosting of the image.

The following examples further define, describe and compare exemplary materials for treating the surfaces of heated fuser members in an electrostatic reproducing apparatus with polysiloxane fluids having tailor-made alkyl groups to displace electroscopic toner, the thermal oxidation product of the fluid being capable of interaction with the fuser member surface to form a thermally stable interfacial layer thereon. Parts and percentages are by weight unless otherwise indicated. The examples are also intended to illustrate the various preferred embodiments of the present invention.

EXAMPLE I

In determining the effectiveness of the polyalkylsiloxane fluids, an electrostatic latent image was formed on a conventional recording surface in a conventional electrostatic reproducing apparatus, and the electrostatic latent image developed with a heat fusible toner comprising carbon black pigmented copolymer, styrene-n-butylmethacrylate, (Xerox Corporation 364 Toner), the toner particles being held on the recording surface in conformance with the electrostatic latent image. The toner image was thereafter transferred to plain paper. The paper having the toner images electrostatically adhered thereto, was then passed at a speed of about 15 inches per second between a fuser roll structure and a backup roll, the fuser roll structure being the type wherein temperature can be controlled as well as nip pressure. The toner image contacted a fuser roll structure which had a 2.0 inch outside diameter and which was 4 inches long. The backup roll had an outside diameter of about 2.0 inches with a 0.1 inch layer of silicone rubber covered with a 0.020 inch coating of fluorinated ethylenepropylene resin on the surface and having a durometer of 65 Shore A. The fuser roll was fabricated from steel. Poly-(methyloctadecylsiloxane) fluid provided by General Electric Company under the trade designation 59-801, was metered onto the fuser roll by means of a doctor blade prior to contacting thereof by the toner image. Fusing latitude or fusing window was then determined. The fusing range at which release of toner occurred, began at 225° F (107°C) and extended to 420° F (216° C). This is an advantage of nearly 200° F (over 100° C) and corresponds to a large increase in fusing component life and machine copy per minute speed.

EXAMPLE II

The toner of Example I was fused on an aluminum roll and a steel roll with no fluid thereon. Immediate release failure was observed in both cases at the minimum fuse temperature of 225° F (107° C) as evidenced by offsetting on the roll.

EXAMPLE III

The toner of Example I was fused on both an aluminum and a steel fuser roll coated with polydimethyl siloxane fluid (silicone oil). The polydimethyl siloxane fluid represents a polymer fluid having non-oxidizable side chains. Immediate release failure was observed in both cases at the minimum fuse temperature of 225° F (107° C).

EXAMPLE IV

Using the toner of Example I and a flat aluminum plate as a fuser member, static release of molten toner was demonstrated when the plate was coated with poly(methyldecylsiloxane) supplied by General Electric Company under the trade designation SF-1147.

In accordance with the stated objects there has been demonstrated a release agent, a fusing process and a fusing member for fixing toner images. In all dynamic cases it was observed that the fuser member is self-repairing the surface being continuously renewable. In the above experiments with the release agents, it was also observed that toner is actually displaced from exposed surfaces of fuser members having the polyalkylsiloxane fluids with at least one oxidizable alkyl group having two or more carbon atoms per molecule thereon coated upon the surface, by reason of the action of the release agent. Experiments as set forth in the above examples were conducted and surface areas were gouged so that toner material became lodged upon the steel surface. The toner material was actively displaced from the surface of fuser members by the action of the release agent, and toner contamination of subsequent copies was avoided. It has been demonstrated that fuser members need no longer be coated with polyalkylsiloxane gums or elastomers in addition to various oils and fluids or with various mixtures of immiscible fluids to promote release of thermoplastic resinous toner from fuser members.

While the invention has been described with respect to preferred embodiments, it will be apparent that certain modifications and changes can be made without departing from the spirit and scope of the invention, and therefore, it is intended that the foregoing disclosure be limited only by the claims appended hereto.

What is claimed is:

1. A method of fusing electroscopic thermoplastic resin toner images to a substrate including the steps of:

(a) forming a film on a heated fuser member in an electrostatic reproducing apparatus, said film being a barrier to electroscopic thermoplastic resin toner and comprising the product resulting from the interaction of the fuser member and a polysiloxane having at least one thermally oxidizable alkyl group per molecule which interacts with the fuser member surface, said polysiloxane having at least one oxidizable alkyl group per molecule being fluid at the temperature of the fuser member and acting as a release fluid film for the electroscopic thermoplastic resin toner;

(b) contacting the toner images on said substrate with the coated, heated fuser member for a period of time sufficient to soften the electroscopic thermoplastic resin toner; and (c) allowing the toner to cool.

2. The method of claim 1 comprising continuously depositing the polysiloxane having at least one oxidizable alkyl group per molecule on the heated fuser member to maintain a toner barrier coating and fluid toner release film of at least about 0.5 micron in thickness.

3. The method of claim 2 wherein the thickness of the film is maintained at about 1 to about 4 microns.

4. The method of claim 1 comprising fusing the electroscopic thermoplastic resin toner to paper.

5. The method of claim 1 wherein said polysiloxane is applied to a fuser member having a copper surface.

6. The method of claim 1 wherein said polysiloxane is applied to a fuser member having a steel surface.

7. The method of claim 1 wherein said polysiloxane is applied to a fuser member having an aluminum surface.

8. The method of claim 1 wherein said polysiloxane is applied to a fuser member having a glass surface.

9. The method of claim 1 wherein at least one thermally oxidizable alkyl group comprises two or more carbon atoms.

10. The method of claim 1 wherein the polysiloxane comprises at least one thermally oxidizable alkyl group having from about 3 to about 22 carbon atoms.

11. The method of claim 4 wherein the polyalkylsiloxane fluid is a polymethylalkylsiloxane.

12. The method of claim 1 wherein the polyalkylsiloxane fluid is a polyarylalkylsiloxane.

* * * * *